United States Patent [19]

Young et al.

[11] 4,291,288

[45] Sep. 22, 1981

[54] FOLDED END-COUPLED GENERAL RESPONSE FILTER

[75] Inventors: Frederick A. Young; Edward L. Griffin, both of Huntington Beach; Louis W. Hendrick, Hermosa Beach, all of Calif.

[73] Assignee: Hughes Aircraft Company, Culver City, Calif.

[21] Appl. No.: 102,290

[22] Filed: Dec. 10, 1979

[51] Int. Cl.[3] ..... H01P 1/208; H01P 7/06

[52] U.S. Cl. ..... 333/212; 333/230; 333/248

[58] Field of Search ..... 333/208-212, 333/227-235, 248, 27, 21 R

[56] References Cited

U.S. PATENT DOCUMENTS

| | | | |
|---|---|---|---|
| 3,899,759 | 8/1975 | Hines et al. | 333/212 |
| 3,969,692 | 7/1976 | Williams et al. | 333/212 |
| 4,020,431 | 4/1977 | Saunders | 333/21 R X |
| 4,167,713 | 9/1979 | Pfitzenmaier | 333/212 |

OTHER PUBLICATIONS

Atia et al.-"General $TE_{011}$-Mode Waveguide Bandpass Filters," IEEE Transactions on Microwave Theory and Techniques, vol. MTT-24, No. 10, Oct. 1976; pp. 640-648.

Lance-"Introduction to Microwave Theory and Measurements," McGraw-Hill, New York, 1964; pp. 100-103 and Title page.

*Primary Examiner*—Marvin L. Nussbaum

*Attorney, Agent, or Firm*—John Holtrichter, Jr.; William H. MacAllister

[57] ABSTRACT

A folded end-coupled general response $TE_{011}$ filter is herein described which achieves all bridge couplings necessary for general bandpass response in a particularly convenient two-tier overlapping structure, where all couplings are made in a single removable iris, and where probe and/or slot couplings are used to achieve coupling of either sign.

4 Claims, 11 Drawing Figures

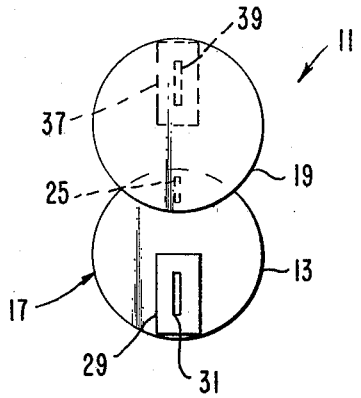
Fig. 1.
Fig. 2.
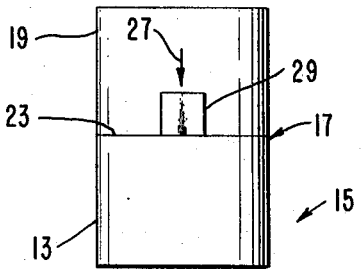
Fig. 3.
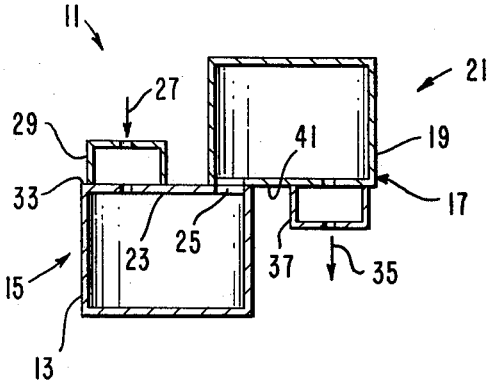
Fig. 4.
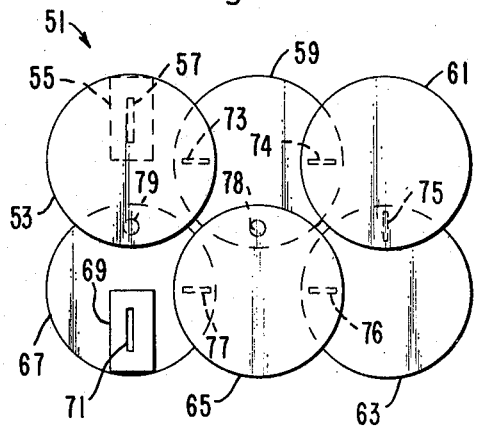
Fig. 5.
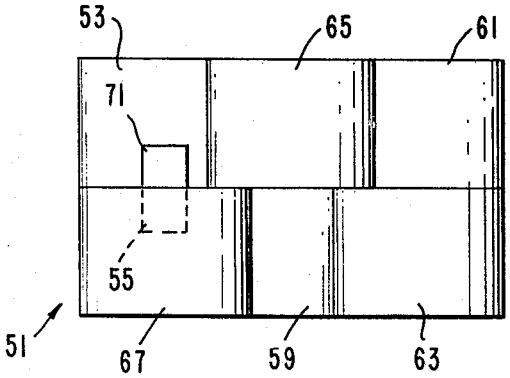

Fig. 6.
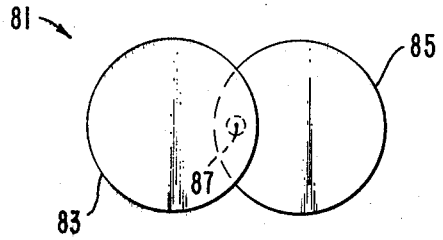
Fig. 8.
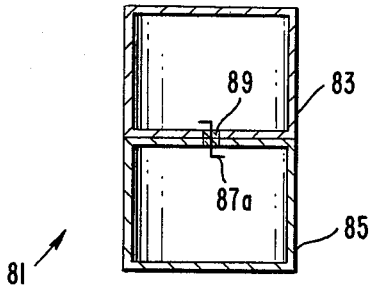
Fig. 7.
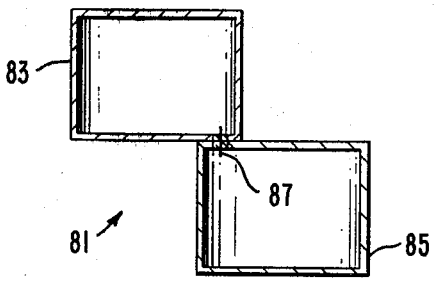
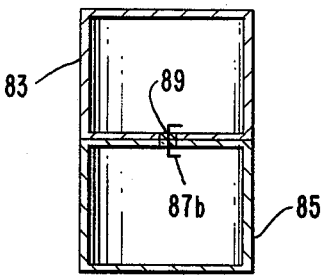
Fig. 9.
Fig. 10.
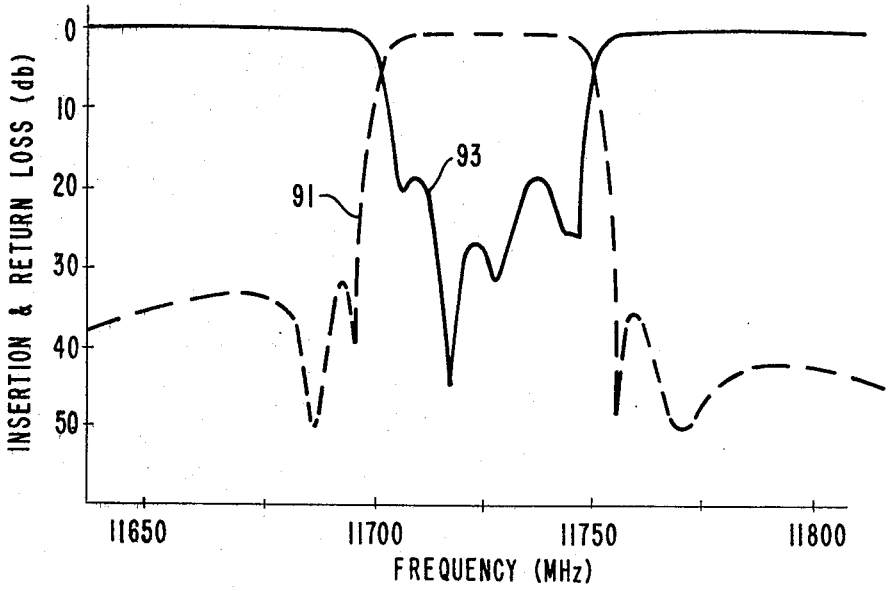

FOLDED END-COUPLED GENERAL RESPONSE FILTER

TECHNICAL FIELD

The invention relates to electromagnetic wave filters and more particularly to symmetrical general response RF filters.

BACKGROUND ART $TE_{011}$ filters have traditionally been quite difficult to work with because the structures used did not have removable irises. Mistakes required scrapping the entire housing.

A typical prior art $TE_{011}$ filter is the ladder type which has been described by Mattaei in a book entitled "Microwave Filters, Impedance Matching Networks, and Coupling Structures," McGraw Hill, N.Y., 1964, pages 921–937. Another prior art contribution to this field is a side-coupled structure which achieved a subset of the canonical bridge couplings, and has been described by Atia and Williams in an article entitled "General $TE_{0111}$ Mode Bandpass Filters," IEEE MIT-24, October 1976.

SUMMARY OF THE INVENTION

In view of the foregoing factors and conditions characteristic of the prior art, it is a primary object of the present invention to provide a new and improved general response filter.

Another object of the present invention is to provide a folded end-coupled general response $TE_{0111}$ filter.

Still another object of the present invention is to provide a compact and efficient general response filter wherein probe couplings are used to achieve couplings of either sign.

Yet another object of the present invention is to provide a general bandpass response filter in a particularly convenient structure wherein all couplings are made in a single removable iris.

A further object of the present invention is to provide a general response $TE_{0111}$ filter which achieves all bridge couplings necessary for a general bandpass response and uses capacitive probes to obtain bridge couplings of specific amplitude and phase in a $TE_{011}$ waveguide structure.

In accordance with an embodiment of the present invention, a folded end-coupled general response filter includes a filter structure having adjacent first and second cavity levels, each level including at least one $TE_{011}$ cavity structure, each cavity structure in one of the two cavity levels overlapping at least one cavity structure in the other of the two levels. The invention also includes mainline coupling means associated with each of the cavity structures for sequentially coupling electromagnetic energy between each of the cavity structures in one of the two levels with an overlapping cavity structure in the other cavity level. Further, the invention includes input/output means mounted on the filter structure and includes an input coupling fixture coupled to one of the cavity structures and an output coupling fixture coupled to another of the cavity structures for introducing an input signal to a first of the cavity structures and providing an output signal from a sequentially last of the cavity structures.

The invention may also include bridge coupling means associated with selected overlapping ones of the cavity structures for allowing the implementation of all possible canonical couplings, and the mainline coupling means may be either slot couplings, probe couplings or a combination thereof.

Further, the invention may include a removable iris plate sandwiched between the two cavity levels of the filter structure, wherein all coupling between overlapping cavity structures are made.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 1 is a top plan view of a two section folded end-coupled general response $TE_{011}$ filter, in accordance with the present invention;

FIG. 2 is a side elevational view of the filter of FIG. 1;

FIG. 3 is an end elevational view of the filter of FIG. 1;

FIG. 4 is a top plan view of a six section folded end-coupled general response $TE_{011}$ filter in accordance with another embodiment of the present invention;

FIG. 5 is a side elevational view of the filter shown in FIG. 4;

FIGS. 6 and 7 are respectively top plan and side elevational views of a portion of a folded end-coupled general response $TE_{011}$ filter, illustrating particular probe coupling embodiments of the invention;

FIGS. 8 and 9 are end elevational views of the filter portion of FIGS. 6 and 7, each showing different probe configuration to provide couplings of the same but of opposite sign;

FIG. 10 is a graph showing the insertion loss and return loss of the six section $TE_{011}$ filter of FIGS. 4 and 5.

DETAILED DESCRIPTION OF THE INVENTION

Figure 11:
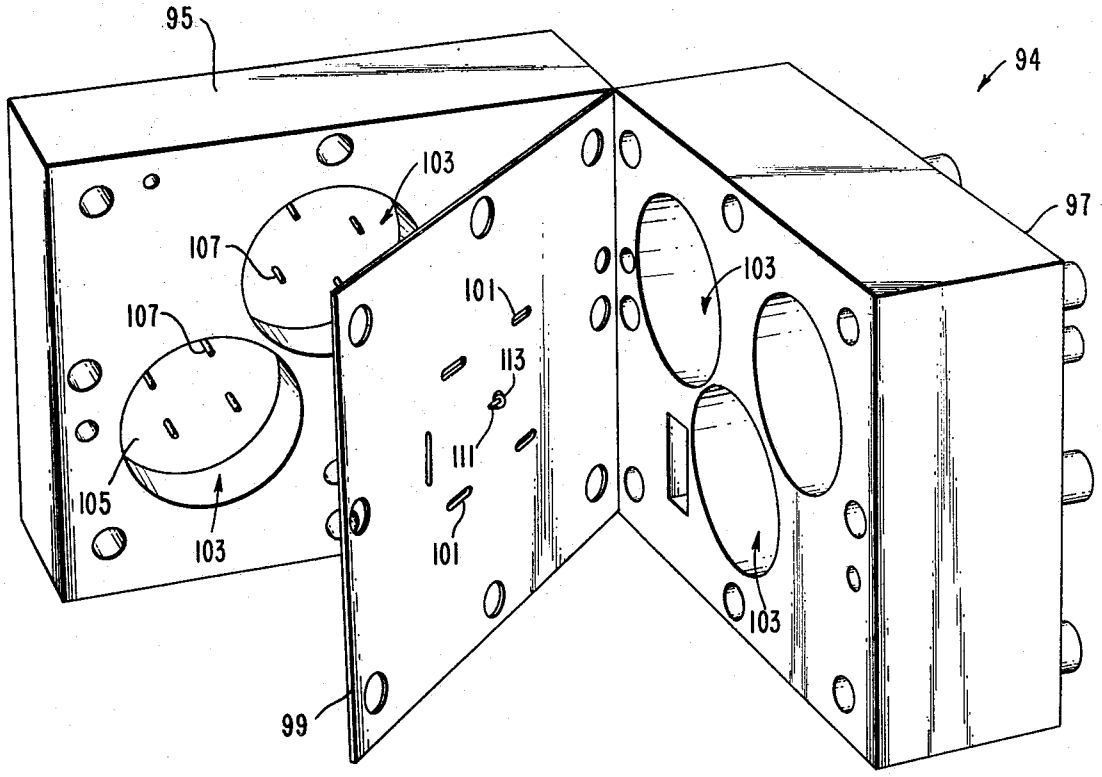
FIG. 11 is a perspective illustration of a constructed six-section folded end-coupled general response $TE_{011}$ filter, showing the separate and removable iris plate that is sandwiched between the two-tier cavity structures, in accordance with yet another embodiment of invention.

Referring now to the drawings and more particularly to FIGS. 1–3, there is shown a simplified representation of a two section, folded end-coupled general response filter 11, in accordance with an embodiment of the present invention.

The filter here includes a first $TE_{011}$ cavity structure 13 in a lower level 15 of a filter structure 17, and a second $TE_{011}$ cavity structure 19 in an upper level 21 of the structure 17, the two cavity structures overlapping at the junction 23 of the two levels. At the junction is disposed a mainline coupling structure, as for example, coupling slot 25, best seen in FIG. 1. In this embodiment, input electromagnetic energy 27 is coupled through a conventional waveguide coupling fixture 29 to the first cavity structure 13 by means of a conventional coupling slot 31 in an upper wall 33 of the structure 13, while the filter's output signal 35 is provided at a conventional waveguide coupling fixture 37 coupled to the second cavity structure 19 through a coupling slot in a lower wall 41 of the second cavity structure.

In this particular embodiment of the invention, the mainline coupling is provided by a slot. However, as will be described later in more detail, probe coupling techniques may also be utilized. Slot couplings always have a positive sign, while probe couplings can be either positive or negative. Since the region of $TE_{011}$ cavity structure overlap is limited, iris coupled filter sections are limited to about ½ percent bandwidth, but probe couplings can be arbitrarily large.

A six section two-tier folded end-coupled general response $TE_{011}$ filter 51, in accordance with another embodiment of the invention, is shown in FIGS. 4 and 5. Here, a first $TE_{011}$ cavity structure 53 having an input port 55 with an associated input port slot 57, is positioned above and in overlapping relationship with a second $TE_{011}$ cavity structure 59. A third such cavity structure 61 is positioned in the upper level with the first structure 53 and overlaps the second cavity structure 59.

Doubling back, a fourth $TE_{011}$ cavity structure 63 lies in the lower level with the second cavity structure 59 and overlaps with the third cavity structure 61, while a fifth such structure 65 is in the upper level and overlaps, on opposite sides, both the lower-disposed fourth cavity structure 63 and a sixth $TE_{011}$ cavity structure 67. An output port 69 is provided on the last mentioned cavity structure and includes an output coupling slot 71 of conventional design. Of course, the input and output ports may be interchanged without changing the operation of the filter.

The mainline coupling between sequential overlapping cavity structures is provided by conventional coupling slots 73, 74, 75, 76 and 77 respectively, as energy progresses from the input coupler 55 to the output coupler 69. In this embodiment, there is also provided bridge coupling apertures 78 and 79, and all canonical couplings are possible. As will be recognized by those working in the microwave art, the slot couplings will always have a positive sign, and since the region of overlap is limited, these iris coupled filters are limited to about ½ percent bandwidth.

In accordance with another embodiment of the invention identified by reference numeral 81 and shown in FIGS. 6 and 7, sequential overlapping $TE_{011}$ cavity structures 83 and 85 are intercoupled by means of conventional probe couplings such as a probe 87 extending into each of the cavity structures and insulated by a conventional feedthrough spacer 89.

FIG. 8 is an end view of the filter 81 showing a probe coupling 87*a* of a desired magnitude and sign, and FIG. 9 illustrates another embodiment where the probe coupling 87*a* provides the same magnitude but of opposite sign.

Referring now to the graph illustrated in FIG. 10, the insertion loss 91 and return loss 93 of a six section $TE_{011}$ filter is constructed in accordance with yet another embodiment of the invention, shown in FIG. 11.

This general response filter 94 includes a first body member 95, a second mating body member 97 and a single removable iris plate 99 sandwiched between the body members, although shown partially separated in FIG. 3 for the sake of clarity. The iris 99 includes mainline coupling slots 101 positioned to allow coupling between overlapping cavities 103. The cavities 103 are tuned by conventional screw plungers 105, and posts 107 seen extending inwardly from the inner surfaces 109 of the plungers 105 are conventional $TM_{111}$ mode suppressors. As described in the previously described embodiments of the invention, in order to provide for control of the magnitude of intercavity coupling and the sign thereof, a coupling probe 111 is shown mounted in the iris 99, supported by an insulator 113.

From the foregoing, it should be evident that there has been described a folded end-coupled general response $TE_{011}$ filter which achieves all bridge couplings necessary for general bandpass response in particularly convenient two-tier overlapping structure where all couplings are made in a single removable iris, and where probe and/or slot couplings are used to achieve coupling of either sign.

It should be understood by those skilled in the art that the materials specified and the general structural configuration illustrated are not critical and that other materials and configurations meeting the teachings of the invention may be used within the scope and contemplation of the invention. For example, the cavity structure may be any conductive material such as brass, copper, silver, gold, aluminum, and the like, and alloys thereof or a non-conductive substrate coated by a conductive material. Also, any conventional process may be utilized such as casting, machining, etc.

What is claimed is:

1. A folded end-coupled general response filter, comprising:

a filter structure having adjacent first and second cavity levels, each level including at least one $TE_{011}$ cavity structure, each cavity structure in one of said levels overlapping at least one cavity structure in the other of said levels, the overlapping structure defining common end walls of said cavity structure;

mainline coupling means in said common end walls of each of said cavity structures for sequentially coupling all mainline electromagnetic energy between each of said cavity structures in one of said levels with an overlapping cavity structure in the other of said levels;

bridge coupling means in selected ones of said common end walls for coupling all bridge coupling energy and allowing implementation of all possible canonical couplings; and input/output means mounted on said filter structure and including an input coupling fixture coupled to one of said cavity structures and an output coupling fixture coupling to another of said cavity structures for introducing an input signal to a first of said cavity structures and providing an output signal from a sequentially last of said cavity structures.

2. The folded end-coupled general response filter according to claim 1, wherein said mainline coupling means includes slot couplings.

3. The folded end-coupled general response filter according to claim 1, wherein said mainline coupling means includes probe couplings.

4. The folded end-coupled general response filter according to claim 1, wherein said mainline coupling means includes both slot and probe couplings.

* * * * *